US005890552A

United States Patent [19]

Scott et al.

[11] Patent Number: 5,890,552

[45] Date of Patent: Apr. 6, 1999

[54] SUPERABRASIVE-TIPPED INSERTS FOR EARTH-BORING DRILL BITS

[75] Inventors: Danny E. Scott, Montgomery; Rudolf C. O. Pessier, Houston, both of Tex.

[73] Assignee: Baker Hughes Incorporated, Houston, Tex.

[21] Appl. No.: 815,063

[22] Filed: Mar. 11, 1997

Related U.S. Application Data

[63] Continuation-in-part of Ser. No. 468,215, Jun. 6, 1995, Pat. No. 5,655,612, and Ser. No. 695,509, Aug. 12, 1996, Pat. No. 5,746,280, which is a continuation-in-part of Ser. No. 468,692, Jun. 6, 1995, Pat. No. 5,592,995, said Ser. No. 468,215, is a continuation-in-part of Ser. No. 300,502, Sep. 2, 1994, Pat. No. 5,467,836, which is a continuation-in-part of Ser. No. 169,880, Dec. 17, 1993, Pat. No. 5,346,026, which is a continuation-in-part of Ser. No. 830,130, Jan. 31, 1992, Pat. No. 5,287,936.

[51] Int. Cl.[6] ..... E21B 10/46

[52] U.S. Cl. ..... 175/426; 175/432

[58] Field of Search ..... 175/401, 355, 175/431, 378, 331, 374, 408, 426, 432

[56] References Cited

U.S. PATENT DOCUMENTS

| | | |
|---|---|---|
| 4,109,737 | 8/1978 | Bovenkerk . |
| 4,604,106 | 8/1986 | Hall et al. . |
| 4,989,578 | 2/1991 | Lebourg . |
| 5,045,092 | 9/1991 | Keshaven . |
| 5,154,245 | 10/1992 | Waldenström et al. . |
| 5,159,857 | 11/1992 | Jurewicz . |
| 5,161,627 | 11/1992 | Burkett . |
| 5,172,777 | 12/1992 | Siracki et al. . |
| 5,173,090 | 12/1992 | Scott et al. . |
| 5,247,923 | 9/1993 | Lebourg . |
| 5,248,006 | 9/1993 | Scott et al. . |
| 5,273,125 | 12/1993 | Jurewicz . |
| 5,281,260 | 1/1994 | Kumar et al. . |
| 5,282,512 | 2/1994 | Besson et al. . |
| 5,287,936 | 2/1994 | Grimes et al. . |
| 5,304,342 | 4/1994 | Hall, Jr. et al. . |
| 5,335,738 | 8/1994 | Waldenström et al. . |
| 5,341,890 | 8/1994 | Cawthorne et al. . |
| 5,346,026 | 9/1994 | Pessier et al. . |
| 5,379,854 | 1/1995 | Dennis . |
| 5,407,022 | 4/1995 | Scott et al. . |
| 5,499,688 | 3/1996 | Dennis . |
| 5,544,713 | 8/1996 | Dennis . |

*Primary Examiner*—Frank Tsay
*Attorney, Agent, or Firm*—Trask, Britt & Rossa

[57] ABSTRACT

Superabrasive cutting elements for rolling cutter bits, and mounting techniques for such cutting elements. The insert-type cutting elements employ self-supporting superabrasive masses on the exposed tips thereof, the elements being mounted to the rolling cutters by insertion of supporting stud-like insert bodies into apertures in the cutter shells so that the exposed exterior of the interface between the superabrasive mass and the supporting cemented tungsten carbide stud lies outside of the depth of cut of the cutting element into the formation, and in some instances beneath the surface of the shell. The self-supporting superabrasive mass may comprise the entire tip of an insert, or the mass may be of a size and orientation to sustain a particular magnitude and direction of loading, the remainder or a majority of the insert tip being covered by a thinner superabrasive shell Further, the cemented carbide stud material may be configured to extend into the superabrasive tip, and may contain one or more recesses sized and configured to receive a portion of the superabrasive mass so as to provide a self-supporting superabrasive mass against selected loads.

57 Claims, 4 Drawing Sheets

SUPERABRASIVE-TIPPED INSERTS FOR EARTH-BORING DRILL BITS

CROSS-REFERENCE TO RELATED APPLICATIONS

This application is a continuation-in-part of U.S. patent application Ser. No. 08/468,215 filed Jun. 6, 1995, now U.S. Pat. No. 5,655,612, which is a continuation of application Ser. No. 08/300,502 filed Sep. 2, 1994, now U.S. Pat. No. 5,467,836, which is a continuation-in-part of application Ser. No. 08/169,880 filed Dec. 17, 1993, now U.S. Pat. 5,346,026, which is a continuation-in-part of application Ser. No. 08/830,130 filed Jan. 31, 1992, now U.S. Pat. 5,287,936. This application is also a continuation-in-part of U.S. patent application Ser. No. 08/695,509 filed Aug. 12, 1996, now U.S. Pat. No. 5,746,280, which is a continuation-in-part of application Ser. No. 08/468,692 filed Jun. 6, 1995, now U.S. Pat. 5,592,995. The disclosure of each of the foregoing commonly-assigned patents and applications is hereby incorporated herein by this reference.

STATEMENT REGARDING FEDERALLY SPONSORED RESEARCH OR DEVELOPMENT

Not Applicable

BACKGROUND OF THE INVENTION

1. Field of the Invention

The present invention relates to bits for drilling subterranean formations, and more specifically, to rolling cutter bits (also termed "tri-cone" or "rock" bits) and superabrasive-tipped, insert-type cutting elements for use on the cutters of such bits.

2. State of the Art

The development of rotary drilling techniques facilitated the discovery and development of deep oil and gas reserves, first in the United States and subsequently throughout the world. The rolling-cutter (also sometimes called "rolling cone" herein) rock bit was a significant advance in drilling techniques, as only softer, more shallow formations could previously be drilled on a commercially-viable basis with early cable-tool equipment and primitive, metal-cutter drag bits. The rolling-cone bit invented by Howard R. Hughes, disclosed in U.S. Pat. No. 939,759, was capable of drilling the hard caprock at the now-famous Spindletop field near Beaumont Tex., thus revolutionizing oil and gas drilling.

Today's rolling-cone or rolling-cutter bits drill at much-improved penetration rates and for vastly greater durations over varying formation intervals in comparison to the original Hughes bit, due to improvements in designs and materials over many intervening decades. However, the basic principles of drilling with rolling-cutter bits remain the same, although are understood to a far greater extent than when this type of bit was originally developed.

Rolling-cone earth boring bits generally employ cutting elements on the cones or cutters to induce high contact stresses in the formation being drilled as the cutters roll over the bottom of the borehole during a drilling operation. These stresses cause the rock of the formation being drilled to fail, resulting in disintegration and penetration of the formation. The cutters of the bit usually, in the context of conventional bit design, rotate or roll about axes which are inclined with respect to the geometric or rotational axis of the bit itself, as driven by the drill string. The rotational axes of the rolling cutters are, in fact, disposed at a substantial angle to the bit axis, extending downwardly and inwardly from the bit leg adjacent the outer bit perimeter toward the centerline of the bit, and the conical shape of most conventional cutters is matched to the cutter axes to cause a plurality of integral teeth or press-fit inserts (generally "cutting elements") projecting outwardly from the side exterior of the cutter to engage the formation along lines of contact extending from the outer base or heel surface of each cutter shell inwardly toward the centerline of the bit. Typically, the cutting elements are arranged in multiple, substantially parallel, generally circumferential rows about the exterior of the cutter, although spiral and other cutting element arrangements are also known in the art. Cutting elements are also located about the bottom periphery of the cutter cones, commonly called the gage surface, and additional cutting elements or scraping elements may be disposed along the intersection of the gage surface and the heel surface of the cutter.

Due to the bit design as briefly described above, and also due to variations in formation material as well as weight on bit (WOB), torque and rotational speed as transmitted to the bit through the drill string, a cutter does not necessarily just roll or rotate over the bottom of the borehole with little or no relative movement between the cutting elements and the formation, but also slides against the formation material due to offset of the cutter axis from a radial plane and variations from a true rolling, perfectly conical cutter geometry. Such sliding also may be caused by precession of the bit about its centerline. Further, the incidence of sliding may be of particular significance during directional drilling operations, wherein the bit is being oriented to drill a path which is not absolutely coincident with its centerline due to the influence of eccentric stabilizers, bent subs, bent housings, or other passive or fixed steering elements, or by active steering mechanisms (arms, pads, adjustable stabilizers, etc.) included in the bottomhole assembly. Such sliding causes the cutting elements of the bit to gouge or scrape the formation, providing another, albeit unintended, mode of cutting in addition to the aforementioned crushing mode.

A generic term for the gouging or scraping action of sliding cutting elements removing formation material is "shear-type cutting", which is the primary mode of cutting in so-called fixed-cutter or "drag" bits, wherein non-movable cutting elements, often having cutting tables or projecting teeth comprised of highly wear-resistant superabrasive materials, cut chips or even elongated strips of material from the formation being drilled. However, the existence of a shear-type cutting in rolling-cutter bits, while recognized, has not been extensively developed in the art. U.S. Pat. Nos. 5,282,512; 5,341,890; and 5,592,995, as well as copending U.S. patent application Ser. No. 08/695,509, the latter filed Aug. 12, 1996 and assigned to the assignee of the present invention, each disclose cutting elements including design features for cutting in shear for use on rolling-cone cutter. Each of the aforementioned patents and application also discloses the use of a discrete, relatively small, preformed diamond element carried on, or in a cavity or recess in, the exterior of the metal insert, typically of a carbide such as cemented tungsten carbide (WC). The metal insert portions of these cutting elements provide a large majority of the exterior surface of the inserts exposed to the formation, drilling fluid, and formation debris.

Another approach to forming insert-type superabrasive cutting elements has been to form a jacket or coating of superabrasive (diamond) material over an insert body of WC, although other metals and alloys have been employed in the art. U.S. Pat. Nos. 4,604,106; 5,045,092; 5,145,245; 5,161,627; 5,304,342; 5,335,738; 5,379,854; 5,544,713 and 5,499,688, as well as copending U.S. patent application Ser.

No. 08633,983, filed Apr. 17, 1996, disclose such jacketed or coated inserts. Also disclosed in some of these patents is the use of discrete, relatively small diamond elements placed or formed in recesses in the surface of an insert, such elements either being exposed to the insert exterior, or covered by a diamond jacket or coating. U.S. Pat. No. 4,109,737 discloses the use of a thin polycrystalline diamond compact layer on the end of a stud-type cutting element for use in drag bits.

Yet another approach to a superabrasive insert-type cutting element for rolling cutter bits is disclosed in U.S. Pat. Nos. 5,159,857; 5,173,090; and 5,248,006. These patents take a radically different approach to superabrasive inserts, using a high-pressure, high-temperature formed, polycrystalline diamond compact core surrounded by a relatively thin, tubular, hard metal jacket and in some cases, an integral base or floor of the same metal, forming a cup-like, diamond-filled structure. The metal jacket is initially formed with an excess wall thickness so that the insert can be machined to a desired diameter for insertion in a rolling cutter.

In an insert comprised primarily of metal and having only small, discrete diamond elements placed thereon at one or two select locations, precise predictions of magnitudes and orientations of cutter and insert loading are required to ensure correct placement and orientation of the diamond elements. Further, the metal insert body and discrete diamond elements in some instances are separately preformed, and require subsequent mutal attachment by brazing or other metallurgical bonding techniques.

In an insert having only a superabrasive (diamond) jacket, the underlying metal stud material ultimately supports the loading to which the insert is subjected during drilling, whether it be the compressive-type loading for which inserts are primarily designed, or the shear-type loading previously mentioned above. The diamond jacket may itself thus be stressed in tension, under which it is very weak and exhibits a remarkably low strain to failure ratio, due to yielding of the underlying metal stud. The yielding of the stud material may result in cracking, spalling, fracture or delamination of the diamond jacket from the stud. Approached from another standpoint, the stress gradient in a thin diamond jacket or shell is extremely great; leading to early failure if not supported by an equally unyielding material. Thermal stresses may also aggravate the aforementioned problems. Further, shear forces may also stress the diamond/metal interface (already residually-stressed from fabrication) in tension, again causing degradation of the diamond jacket or its bond to the stud.

Diamond-core inserts having only a metal shell or jacket surrounding the diamond mass extending substantially the length of the insert do not suffer from loading-induced damage in the same manner as the diamondjacketed inserts since the diamond core material itself takes the loading, but such inserts cannot normally sustain impact or high stress on the superabrasive tip without cracking of the metal shell or jacket, which frequently leads to loss of the insert from the cutter. Moreover, the diamond-core inserts require a relatively large volume of expensive diamond particles for forming the diamond core, and the method of forming such diamond-core cutting elements yields a very small number of parts for each run of the diamond press.

It has been contemplated to form a drag bit diamond cutting element with a substantial superabrasive structure, as disclosed in commonly-assigned copending U.S. patent application Ser. No. 08/602,076 and U.S. patent application Ser. No. 08/602,050, each filed on Feb. 15, 1996 and hereby incorporated herein by this reference. However, only somewhat generalized developments were disclosed regarding the concept of forming rolling-cutter inserts in terms of specific internal and external structure, or to with regard the mounting inserts in the rolling cutter itself.

Thus, there remains a need for an effective, robust, insert-type superabrasive cutting elements having utility on rolling cutter type bits, susceptible to fabrication in an efficient and economical manner using known manufacturing techniques and mountable to a rolling cutter in a manner which minimizes potential loss of, or damage to, the cutting element during service.

BRIEF SUMMARY OF THE INVENTION

The present invention provides a superabrasive, insert-type cutting element for use in rolling cutter bits, such cutting element sustaining the loading on the cutting element through a self-supporting mass of superabrasive material comprising at least a substantial portion of the exposed exterior surface of the cutting element projecting above the cutter shell surface, and wherein the cutting element is secured within an aperture in the cutter shell surface by a fracture-tough material preferably comprising a cemented metal carbide stud underlying the superabrasive mass. This design is in marked contrast to those of the prior art as discussed above, wherein only a superficial diamond shell is disposed over a load-supporting metal stud body, a discrete diamond element is formed or affixed on such a stud body, a combination of the two foregoing features is employed, or a diamond-cored insert having only a thin, cylindrical, tubular metal jacket thereabout is used. Specifically, the mass of superabrasive material employed in the cutting elements of the present invention comprises a substantial portion of the projecting end of the cutting element which engages the formation during drilling operations, and is supported from beneath within the cutter shell by the fracture-tough carbide. The mass of superabrasive material is of sufficient depth, at least in the direction or directions of predominant anticipated loading on the cutting element (which vary depending upon the cutting element's location and function as a gage, heel or inner row cutting element) to sustain such loading of a magnitude sufficient to yield the underlying carbide material without incurring fracture, spalling or delamination of the superabrasive material.

An additional, advantageous feature of the present invention is the cooperative configuration of the cutting element and its corresponding receiving aperture in the rolling cutter to ensure that any interface between the superabrasive mass and the stud body, particularly in and flanking the direction of movement of the cutting element against the formation, is located above (i.e., outside of) the depth of cut (DOC) effected by the insert into the formation. In one embodiment, the exposed superabrasive/metal interface lies below the surface of the cutter shell when the stud or insert body of the cutting element has been secured in the cutter shell. Thus, the somewhat highly-stressed region surrounding the boundary between the metal and the superabrasive of the cutting element is vertically offset from shear stresses generated by contact of the insert with the formation. Further, in the instance where the exposed exterior boundary of the interface is recessed within the cutter shell, it is substantially protected from the erosive and abrasive environment in the borehole.

A further feature of the invention is the ability to configure the superabrasive mass so as to exhibit or define at least one cutting edge to engage the formation being drilled in a shear-type cutting action, and to preferentially sustain loads from both shear and crushing-type cutting.

According to a preferred embodiment of the present invention, the superabrasive material employed comprises a polycrystalline diamond compact (PDC), the supporting stud or insert body comprising the remainder of the cutting element comprises cemented tungsten carbide, and the cutting element is interference (i.e., press) fit, brazed or otherwise secured into an aperture of suitable depth in the surface of the cutter shell.

DETAILED DESCRIPTION OF THE INVENTION

Figure 1:
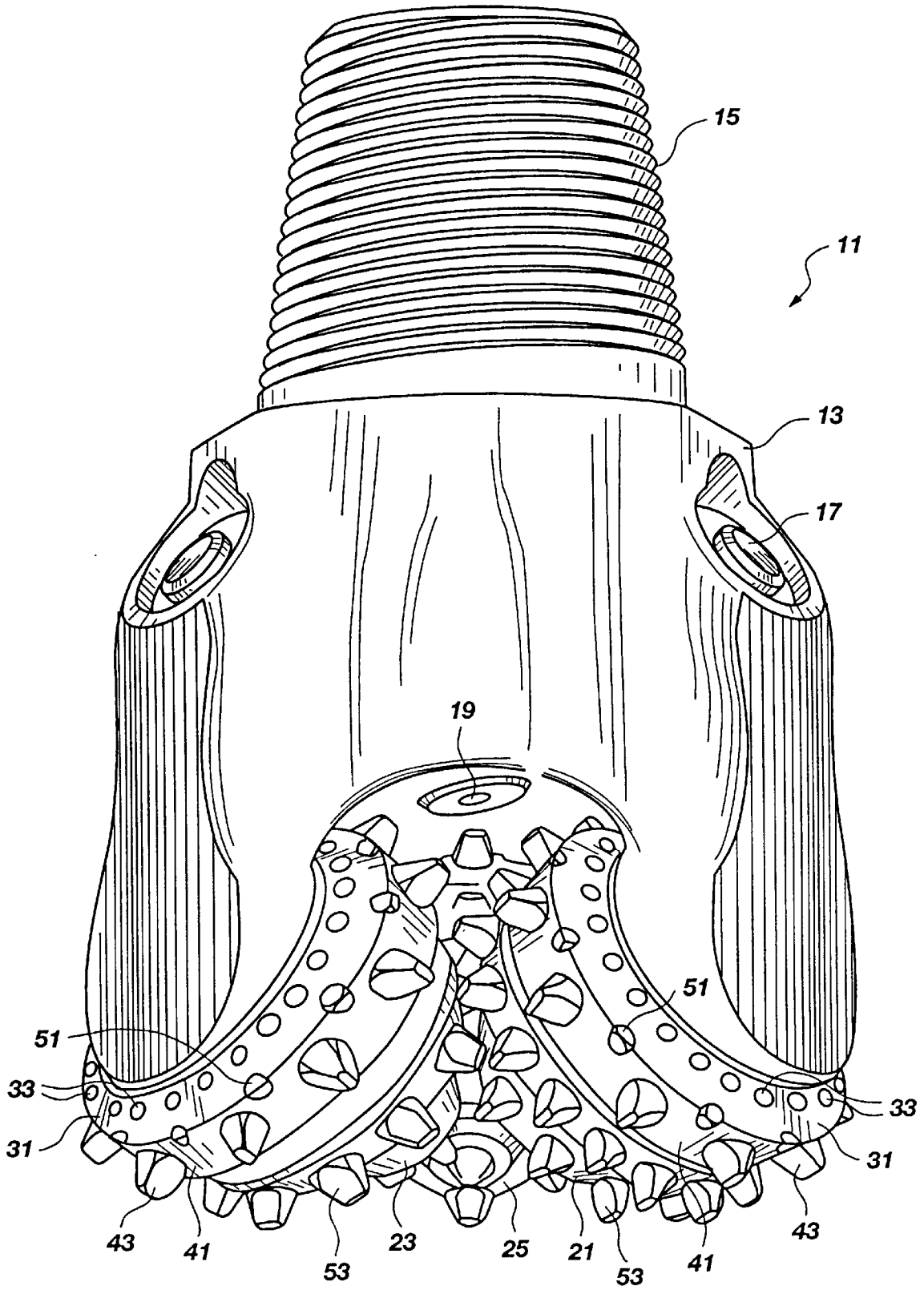
FIG. 1 is a perspective view of a bit for drilling subterranean formations in accordance with the present invention.

Referring to the several views of the drawings, and in particular to FIG. 1, a drill bit according to the present invention is depicted. Bit 11 includes a bit body 13, which includes a threaded shank 15 at its upper end for connection to a drill string, as known in the art. Each leg or section of bit 11 is provided with a lubricant compensator 17, a preferred embodiment of which is disclosed in U.S. Pat. No. 4,276,946 to Millsapps. At least one nozzle 19 is provided in bit body 13 to direct drilling fluid received from the interior of the drill string for cooling and lubrication of the cutting action of bit 11, and removal of material being cut from the formation being drilled. Three cutters, 21, 23 and 25, of generally conical exterior configuration, are each rotatably secured to a bearing shaft associated with and projecting from each leg of bit body 13. Each cutter 21, 23, 25 possesses an exterior cutter shell surface including a gage surface 31 and a heel surface 41.

A plurality of cutting elements, in the form of stud-like inserts, is arranged in generally circumferential rows extending about each cutter 21, 23, 25. The gage surface 31 of each cutter bears a row of gage cutting elements 33, while a heel surface 41 of each cutter intersecting the gage surface 31 of that cutter bears at least one row of heel cutting elements 43. In certain applications, it is preferred that at least one scraper cutting element 51 is secured to each cutter's shell surface in the general location of the intersection of the gage and heel cutting surfaces, 31 and 41, respectively, intermediate a pair of heel elements 43.

The outer portion of the cutting structure of each cutter, comprising heel cutting elements 43, gage cutting elements 33, and a secondary cutting structure in the form of at least one scraper cutting element 51, crushes and scrapes formation material at the corner and sidewall of the borehole as cutters 21, 23, 25 roll and slide across the formation material at the borehole bottom as bit 11 rotates under applied torque and WOB. The projecting ends of heel cutting elements 43 effect the primary cutting action, assisted secondarily by scraper cutting elements 51. As the outermost surfaces of heel cutting elements 43 wear, gage cutting elements 33 contact and engage the sidewall of the borehole to maintain gage diameter. Cutting elements 53 arranged in generally circumferential rows radially inward of the rows of heel cutting elements 43 are referred to as inner cutting elements, several rows of such inner cutting elements 53 being located on each cutter 21, 23, 25. Thus, each cutter 21, 23, 25 typically includes a row or ring of gage cutting elements 33, one or more rows or rings of heel cutting elements 43, and one or more rows or rings of inner cutting elements 53.

The strength and wear resistance, and cutting efficiency, of gage cutting elements 33, heel cutting elements 43 and inner cutting elements 53, which project outwardly from the cutter shell surfaces to a substantial extent, is enhanced by forming a substantial portion of such outer ends or projections of elements 33, 43 and 53 of a self-supporting mass of superabrasive material structured to effectively crush the formation with such superabrasive mass under extreme compressive stresses. Thus, high subsurface, or internal, tensile stresses induced in the cutting elements by the extreme contact stresses may be contained within the high-strength superabrasive material mass. Preferably, the superabrasive mass exceeds at least about ten percent of the volume of the "working tip" of the cutting element, the term working tip being defined as that portion of the cutting element designed to engage the formation. Use of a relatively large superabrasive mass also enhances heat transfer from the area of engagement of the cutting element with the formation, superabrasives such as diamond providing far superior heat transfer to carbides.

Significantly, stress at the superabrasive-to-insert body interface of cutting elements of the invention employing a self-supporting mass of superabrasive material is much lower than with the use of thin, prior art diamond shells or jackets. The self-supporting superabrasive mass of cutting elements of the invention prevents high stress from service (drilling) being superimposed on the high residual stress from fabrication located in the interface region. Moreover, the use of a single, unitary superabrasive material mass to accommodate cutting loads is advantageous as avoiding the need to sustain such loads with the markedly lower adjacent material yield modulus of the underlying carbide present in a superabrasive "shell" type cutting element, and thus avoids the necessity of using a plurality of layers of diamond and/or carbide to change the modulus gradually between the exterior and the core of the cutting element.

Further, contrary to conventional wisdom as espoused by synthetic diamond manufacturers, to the effect that a thicker diamond table or mass is less durable than a thin one, the inventors have discovered that this is not the case, provided the thicker table or mass is fabricated with comparable integrity to a thinner one. In addition, it has also been demonstrated by the inventors, again contrary to conventional teachings in the art, that superabrasive inserts are able to sustain sufficient side-loading (i.e., substantially transverse to the longitudinal axis of a stud-type cutting element) without substantial degradation so as to be effective in shear-type cutting under such loading, as long as the depth of superabrasive material entering the formation is equal to or greater than the depth of cut (DOC) into the formation. Should DOC exceed the depth to the diamond/carbide interface, however, delamination of the diamond from the carbide may rapidly occur.

Since a typical DOC for a rolling cutter bit ranges (depending on formation strength and application) from about 0.010 to about 0.150 inch, and it is now known in the art to fabricate diamond "tables" on the ends of carbide cylinders to a thickness at least approaching 0.150 inch for drag bit cutting element applications (wherein a cutting edge of a two-dimensional cutting face oriented transversely to the longitudinal axis of the cylinder is placed at a negative back rake to the formation to shear material therefrom), a rolling cutter bit cutting element with a self-supporting superabrasive tip or cap may thus be economically fabricated with, for example, a 0.150 inch superabrasive/metal interface surface-to-superabrasive mass tip distance which provides the aforementioned ability to remove the interface from the DOC and, if desired, even recess or hide the diamond/metal interface below the lip of the aperture in the cutter shell into which the cutting element is secured. Further, with appropriate sintering (pressing) process controls during fabrication of the superabrasive, and with post-press annealing, it is believed that superabrasive (PDC) mass depths of significantly more than 0.150 inch are attainable, affording potential DOCs much greater than are typically employed in hard, abrasive formation bits. It is also possible to simulate a relatively deeper or longer superabrasive tip without using only superabrasive material in the tip by configuring a central portion of the carbide stud to extend into the superabrasive, the superabrasive/carbide interface thus being lower (toward the stud base) on the exterior of the cutting element and higher in the center. Of course, with such a configuration, the superabrasive must still be of sufficient depth or thickness to sustain and absorb cutting loads, rather than transmitting loads to the more-yieldable, underlying material of the stud. Due to the different magnitudes and directions of loading experienced by rolling cutter cutting elements mounted in different positions on the cutters and the ability to at least in part predict same with some certainty, it may also be possible to configure a cutting element with a substantial superabrasive mass directionally oriented to sustain specific, predicted or demonstrated loading patterns, while a substantial remainder of the projecting tip of the cutting element is covered with a thinner shell for abrasion and erosion resistance.

Preferably, at least some of the cutting elements 33, 43 and 53 also exhibit or define at least one cutting edge for shearing engagement with the borehole formation material. As used herein, the term "superabrasive" is synonymous with the alternative phraseology "superhard" and is intended to include, without limitation, natural diamond, conventional and thermally stable polycrystalline diamond compacts (PDCs), and cubic boron nitride, any of which materials may also be coated with the same or another superabrasive as by chemical vapor deposition to produce a superabrasive film-coated cutting element. Likewise, the cutting element surfaces may be ground, lapped or even polished to an extremely smooth surface finish, such as, by way of example, a mirror finish, as taught by commonly-assigned U.S. Pat. No. 5,447,208. In a preferred embodiment, the cutting elements 33, 43 and 53 comprise superabrasive masses of conventional (non-thermally-stable) polycrystalline diamond compact material, formed onto stud-like, generally cylindrical cemented tungsten carbide bodies during the ultra-high pressure, ultra-high temperature pressing process employed to form such compacts. Alternatively, the superabrasive masses may be formed as cylindrical or other-shaped blanks and machined to shape by electrodischarge grinding (EDG) or electrodischarge machining (EDM) techniques, as known in the art. The shaped blanks may then be brazed to suitable carbide studs or other base shapes for securement to the cutter.

Various embodiments of the insert-type cutting elements of the present invention will now be described with reference to drawing FIGS. 2 through 20. For the sake of convenience and clarity, common features of each of the embodiments of the cutting elements are identified with common reference numerals. For example, each of the cutting elements illustrated includes a hard, fracture-tough insert body 100, preferably formed from a sintered or hot-isostatic-pressed carbide such as so-called cemented tungsten carbide. Each of the inventive cutting elements further comprises a superabrasive mass 102 secured to insert body 100 which, when projecting from a shell surface of a cutter such as cutters 21, 23 or 25, projects therefrom a distance sufficient to effect a desired DOC in the formation to be drilled. As used herein, the term "superabrasive" includes previously-referenced materials and, more generically, materials having hardnesses in excess of 2800 on the Knoop hardness scale. The interface 104 between insert body 100 and superabrasive mass 102 is characterized by an exposed exterior boundary 106 which, at least in the direction of rotation of the cutter on which an inventive cutting element is mounted, lies above (outside) the DOC for which the cutting element and bit are designed, given the predicted rock characteristics of the formation to be drilled.

Figure 2:
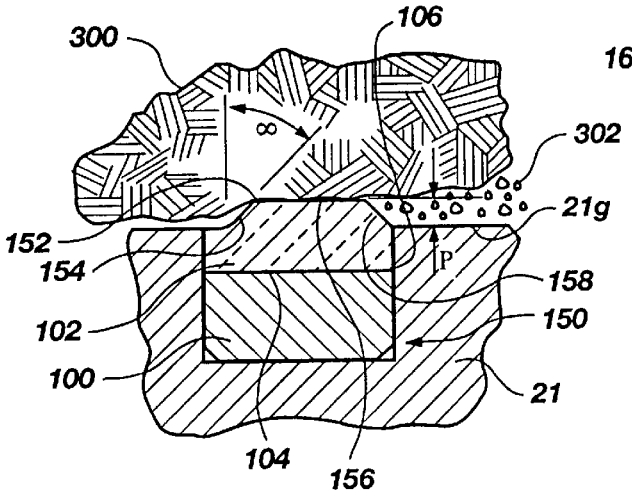
FIG. 2 is a side partial sectional elevation of a first gage cutting element according to the invention.

Referring now to FIG. 2 of the drawings, there is depicted a first gage cutting element 150 according to the present invention. The geometry and dynamics of the cutting action of earth-boring bits is extremely complex, but the operation of gage cutting element 150 of the present invention (to be placed as a gage element 33 in the bit of FIG. 1) is believed to be similar to that of a metal-cutting tool. As an exemplary cutter 21 rotates along the bottom of the borehole, the gage surface 21*g* of that cutter 21 contacts the sidewall 300 of the borehole. Because the gage surface 21*g* contacts the sidewall 300 of the borehole, likewise the protruding gage cutting element or insert 150 contacts the sidewall 300 and the cutting edge 152 of the element or insert 150 shearingly cuts into the material of sidewall 300. The bevel 154, from which cutting edge 152 extends, comprises a cutting face for cutting element 150 and serves as a cutting or chip-breaking surface that causes shear stress in the material of the borehole sidewall 300, thus shearing off fragments or chips of the borehole material. In the embodiment of FIG. 2, bevel 154 comprises a substantially flat or planar surface extending across cutting element 150 and oriented substantially transversely to the direction of cut, and cutting edge 152 is substantially linear. The remainder of cutting element 150 protruding above gage surface 21*g* on the same plane as bevel or cutting face 154 comprises a circumferential, frustoconical bevel 158. If the substantially flat outer face 156 of the element or insert 150 remains at least partially in contact with the sidewall 300 of the borehole, it is subject to more abrasive wear during operation, since some fine material 302 passes through the highly stressed interface between cutting element 150 and the formation. Therefore, the preferred insert design has the leading cutting edge 152 shearing the formation and slightly higher than the flat outer face 156, which is inclined by a small clearance angle of about 5 degrees with respect to the gage surface, and thus out of substantial contact with the borehole wall. Such inclination may be effected by appropriate angular orientation of the cutting element 150 in the cutter shell, or by fabrication of cutting element 150 with outer face 156 at a slight angle to the perpendicular to the longitudinal axis of the cutting element.

The cutter face 156 of cutting element or insert 150 should extend a distance p from the gage surface 21*g* during drilling operations. Such protrusion enhances the ability of the cutting edge 152 to shearingly engage the borehole sidewall 300 and provide clearance for the displacement of the sheared material to the sides of the cutting element 150. During drilling operations in abrasive formations, the gage surface 21*g* will be gradually eroded away, increasing any distance p the outer face 156 protrudes or extends from the gage surface 21*g*. If the cutting outer face 156 extends much further than 0.075 inch from the gage surface 21*g*, the insert or element 150 may experience unduly large bending stresses, which may cause the cutting element or insert 150 to break or fail prematurely, Therefore, the outer face 156 should not extend a great distance p from the gage surface 21*g* at assembly and prior to drilling operations. The outer face 156 may be flush with the gage surface 21*g* at assembly, or preferably may extend a distance p of a minimum of 0.010 inch, and most preferably in the range of between 0.015 and 0.060 inch, for most bits.

The dimension of the cutting edge 152 and orientation of bevel or cutting face 154 is significant to the cutting operation of cutting element 150. In cutting the sidewall 300 of the borehole, the bevel angle of bevel 154 defines a rake angle $\alpha$ with respect to a perpendicular to the portion of the borehole sidewall 300 being cut. This rake angle $\alpha$, in the cutting elements according to the present invention disclosed herein, may also be measured relative to the longitudinal axis of the cutting element. It is believed that rake angle $\alpha$ should be negative (such that bevel or cutting face 154 leads cutting edge 152 in the direction of cutting element movement against borehole sidewall 300) to avoid unduly high loading of the cutting edge 152. The choice of rake angle$\alpha$ depends upon the aggressiveness of the cutting action desired. At a high negative rake angle $\alpha$ such as 90 degrees, there is no cutting edge and thus no shearing action; at a low rake angle $\alpha$ such as 0 degrees, wherein the bevel or cutting face 154 is perpendicular to the borehole sidewall 300, shearing action is at its maximum for a negative or neutral raked cutting face, but such a cutting face orientation is accompanied by high loading of the cutting edge 152, which may induce premature failure. It is believed that an intermediate, negative rake angle $\alpha$, in the range of between 15 and 60 degrees, provides a satisfactory compromise between providing an effective cutting action for cutting element 150 and a satisfactory operational life. Rake angles in the aforementioned range adjacent to cutting edges are also believed to be suitable for the embodiments of the cutting elements subsequently described herein.

As noted previously, gage cutting element or insert 150 includes a body 100 and a superabrasive mass 102, with an interface 104 between the two materials having an exposed boundary 106 on the exterior of the element 150. Further, as shown in FIG. 2, both interface 104 and boundary 106 lie beneath the gage surface 21*g* within the body of the cutter 21 and, as shown, necessarily above the DOC of the cutting element 150 against the borehole sidewall 300.

Figure 3:
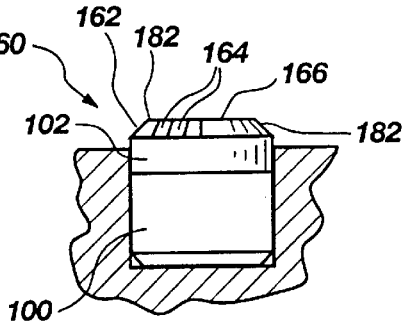
FIG. 3 is a side partial sectional elevation of a second gage cutting element according to the invention.

FIG. 3 depicts a second gage cutting element 160, element 160 also including a body 100 surmounted by a superabrasive mass 102 of sufficient depth to sustain both compressive and subsurface tensile stresses encountered during drilling. Unlike element 150 of FIG. 2, in element 160, the protruding portion of superabrasive mass 102 may be substantially symmetrical, with a bevelled edge surface 162 extending completely around the cutting element 160. Bevelled edge surface 162 may be of a smooth, continuous frustoconical configuration as depicted on the right-hand side of cutting element 160, or comprise a series of laterally-contiguous chamfer flats 164 extending about the periphery of element 160 as shown on the left-hand side, or comprise an arcuate, partial frustoconical surface in part and a plurality of flats in part, a single-flat/frustoconical surface configuration being previously depicted in FIG. 2. In either case, a cutting edge 182 (when facing in the direction of cutter movement, substantially transverse to the axis of cutting element 160) lies at the intersection of a portion of bevelled edge surface 162 and flat outer face 166.

Figure 4:
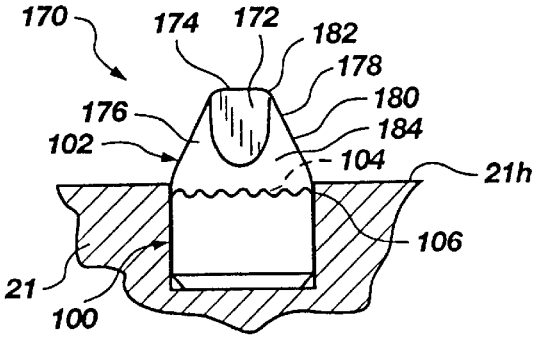
FIG. 4 is a side partial sectional elevation of a first heel cutting element according to the invention.
Figure 5:
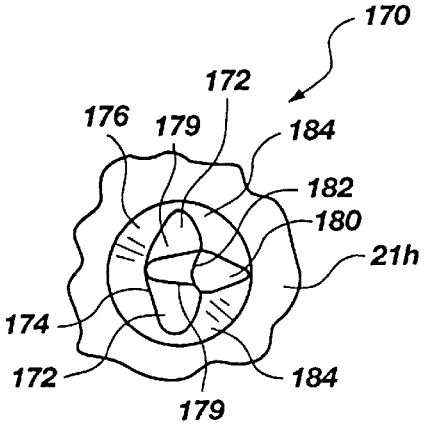
FIG. 5 is a top elevation of a first variant exterior topographic configuration for the cutting element of FIG. 4.
Figure 6:
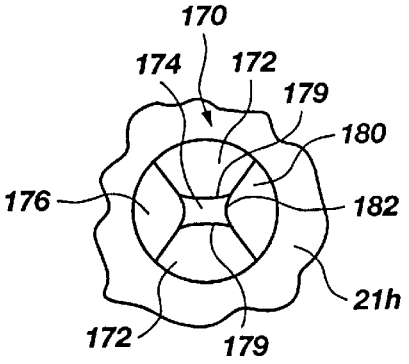
FIG. 6 is a top elevation of a second variant exterior topographic configuration for the cutting element of FIG. 4.

FIGS. 4, 5 and 6 depict variants of a first heel cutting element 170 according to the present invention, element 170 including an insert body 100 carrying a superabrasive mass 102, the interface 104 and exterior boundary 106 between the two lying below a heel surface 21*h* of an exemplary cutter 21. It should be noted that interface 104 is convoluted to provide more surface area for a stronger interface between insert body 100 and superabrasive mass 102. The convolutions are generally sinusoidal, and may extend across the interface as parallel ridges and valleys, or the ridges and valleys may extend radially from the central area of the element 170 to the boundary 106. The exterior of superabrasive mass 102 is configured with two opposing and mutually converging flats 172 disposed at substantially similar angles to the longitudinal axis of the element 170, each flat 172 terminating at a ridge or crest surface 174 at the outermost end of element 170. The trailing surface 176 (taken in the direction of the cutting element's movement axially toward the center of the bit, which occurs as a result of cone offset) is of partial frustoconical configuration, while the leading surface 178 is provided with a shear cutting face 180 (hereinafter and in other embodiments referred to as a "cutting face") with a cutting edge 182 at its distal or outermost end. The remainder of leading surface 178 may comprise two partial frustoconical flanks 184 disposed to either side of cutting face 180. As shown in FIGS. 5 and 6, cutting face 180 may be of varying configurations, FIG. 5 showing a triangular cutting face 180 and FIG. 6 showing a frustoconical cutting face 180. If the relative movement between a heel cutting element 170 and the formation is due to circumferential drag caused by a less than perfect true rolling cone geometry, then the flats 172 become the cutting faces and the sides of the ridge or crest 174 become cutting edges 179. Since the heel row is usually on a diameter, smaller than the true rolling diameter, it tends to be driven forward, causing a heel cutting element 170 to cut with the leading side with respect to the cutter rotation.

Figure 7:
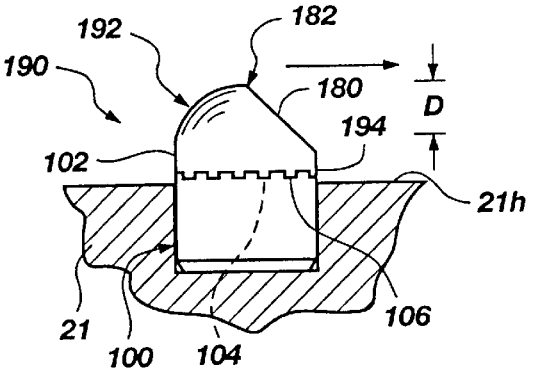
FIG. 7 is a side partial sectional elevation of a second heel cutting element according to the invention.
Figure 8:
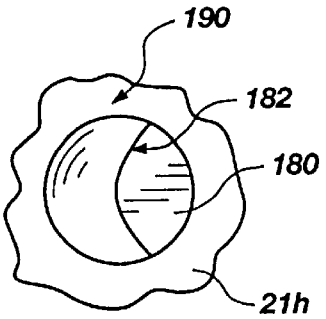
FIG. 8 is a top elevation of an exterior topographic configuration for the cutting element of FIG. 7.
Figure 9:
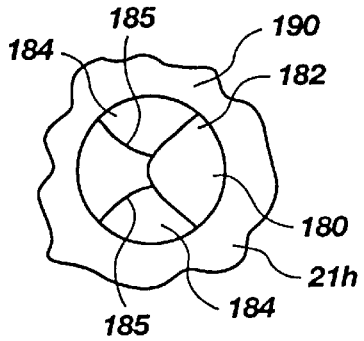
FIG. 9 is a top elevation of a first variant exterior topographic configuration for the cutting element of FIG. 7.

FIGS. 7, 8 and 9 depict variants of a second heel cutting element 190 according to the present invention, element or insert 190 including a body 100 surmounted by a superabrasive mass 102 having an exterior surface with an outermost, generally hemispherical portion 192 extending to a cylindrical portion 194 of like diameter to that of body 100. Hemispherical portion 192 is further provided with a single cutting face 180 having a cutting edge 182 and facing the direction of axial, inward movement of the heel cutting elements of cutter 21 as shown in FIG. 8. However, it may also have side cutting faces 184 with cutting edges 185 to provide shear cutting induced by circumferential drag, as shown in FIG. 9. Of course, a partially linear and partially non-linear cutting edge may also be formed. As shown in FIG. 7, cutting edge 182 may be located at or slightly below the apex of cutting element 190 so that crushing loads on superabrasive mass 102 are primarily sustained by the larger, rounded end surface of hemispherical portion 192. As also shown in FIG. 7, there is a convoluted interface 104 between body 100 and superabrasive mass 102 having a boundary 106 which is of a square-wave configuration. Again, as with the prior embodiment, the interface may extend linearly and in parallel transversely across cutting element 190, or radially from proximate the center of the element 190. In this embodiment, however, the interface 104 and boundary 106 lies well above the surface 21*h* of cutter 21, but also above (outside) the projected DOC, D, of cutting element 190 into the formation.

Figure 10:
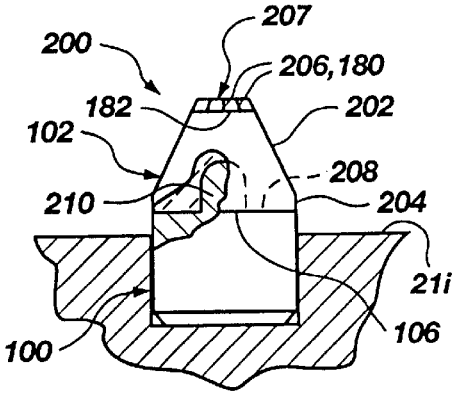
FIG. 10 is a side partial sectional elevation of a first inner cutting element according to the present invention.

FIG. 10 shows a first inner cutting element 200. Cutting element 200 includes a frustoconical projecting portion 202 comprised of superabrasive mass 102, portion 202 being contiguous with a cylindrical lower portion 204 of like diameter to that of body 100. Projecting portion 202 is topped with a plurality of laterally-contiguous flats or facets 206 extending circumferentially around the element 200. Facets 206 may be angled at the same angle as the sidewall of portion 202, or be placed at greater or lesser angles, depending on the backrake desired for shear-type cutting and the need for durable cutting edges. The top of element 200 comprises bearing flat 207, surrounded by facets 206 which (in all directions of movement between cutting element 200 and the formation) provide cutting faces 180, defining cutting edges 182 at the boundaries between facets 206 and flat 207. While termed a "flat", it is also contemplated that surface 207 may exhibit a slight concave projection above facets 206. It is also notable that interface 204 comprises a radially-extending, ring-shaped portion 208 surrounding a central protrusion 210 of body 100 into superabrasive mass 102. While conserving superabrasive material and placing mass 102 under beneficial compressive stresses after the high-temperature fabrication process, resulting from different coefficients of thermal expansion (CTE) of the two materials, protrusion 210 nonetheless affords a substantial-enough thickness of superabrasive material so that it is self-supporting against both compressive stresses and subsurface tensile stresses. It should also be noted that protrusion 210 may be laterally offset with respect to the axis of cutting element 200 to provide additional superabrasive mass depth toward one side thereof. Boundary 106 between superabrasive mass 102 and body 100 lies above the inner surface 21*i* of cutter 21, but also above (outside) the predicted DOC, or projection of cutting element 200 into the formation during drilling. Thus, the entire depth of cut is taken by superabrasive material.

Figure 11:
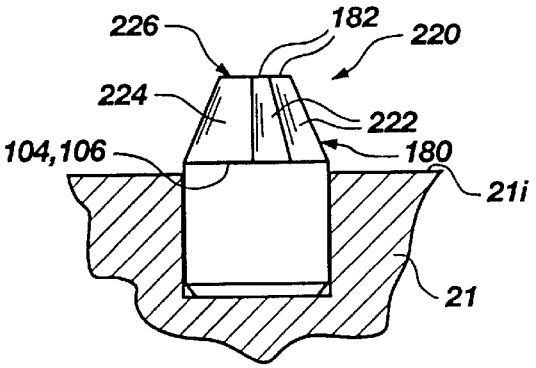
FIG. 11 is a side partial sectional elevation of a second inner cutting element according to the present invention.
Figure 12:
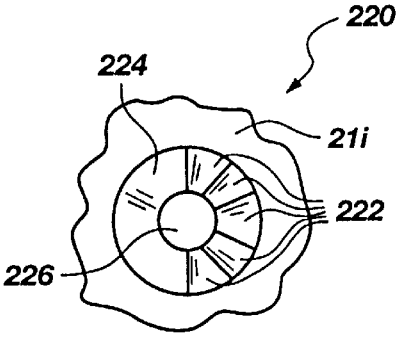
FIG. 12 is a top elevation of an exterior topographic configuration for the cutting element of FIG. 11.

Second inner cutting element 220 depicted in FIGS. 11 and 12 is similar to element 200, but provides a series of longitudinally-extended flats or facets 222 on the leading surface of the cutting element 220, taken in the radially inward and circumferential direction of movement of the inner row cutting elements 53 on cutter 21. Each facet 222 comprises a portion of a cutting face 180 and has a cutting edge 182 at the outermost end thereof, the trailing surface 224 of element 220 being of frustoconical configuration and the outermost end of element 220 comprising a bearing flat 226 to sustain compressive loads. As noted previously with respect to surface 207, surface 226 may be truly planar, or rounded. Interface 104 and boundary 106 on cutting element 220 as shown lie in a single, radial plane and are disposed below the inner surface 21*i* of cutter 21, but as with the cutting element 200 of FIG. 10, the insert body material may protrude into the interior of the superabrasive mass.

Figure 13:
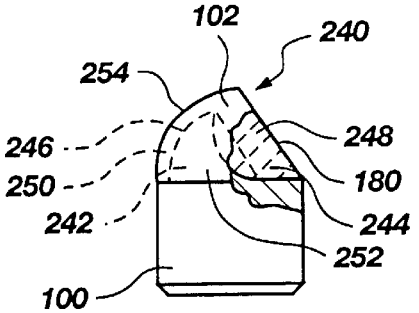
FIG. 13 is a side elevation of a heel cutting element according to the invention, showing a portion of the insert body protruding into the superabrasive tip and configured to provide a self-supporting superabrasive mass against a degree of side loading.

FIG. 13 depicts another heel cutting element 240 similar to that of FIGS. 7–9, providing a similar cutting face 180 but showing a protrusion 242 of body 100 into superabrasive mass 102, protrusion 242 including a cavity 244 extending thereinto on the leading side of element 240, and a partially-hemispherical outer surface 246 on the trailing side. This configuration ensures a sufficiently-thick or deep superabrasive mass portion 248 on the leading, highly-stressed side of element 240, and a thinner, superabrasive shell portion 250 on hemispherical sides 252 and 254 of element 240.

Figure 14:
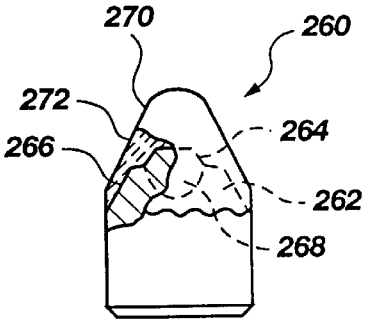
FIG. 14 is a side elevation of a cutting element according to the invention, showing a portion of the insert body protruding into the superabrasive tip and configured to provide an enhanced, self-supporting, superabrasive mass in selected areas against loading sustained by the superabrasive tip of the cutting element.

FIG. 14 depicts another cutting element 260 configured for high compressive loading and including a protrusion 262 of body 100 into superabrasive mass 102. However, unlike protrusion 242, protrusion 262 includes an annular recess 264 to provide additional superabrasive mass depth along the end periphery of protrusion 262 into superabrasive mass 102. The exterior 266 of protrusion 262 follows the generally conical exterior shape 270 of mass 102, thus providing a relatively thinner shell 272 of superabrasive material around the lateral periphery of the cutting element 260. If desired in certain applications, in order to provide additional superabrasive material depth in alignment with the longitudinal axis of cutting element 260, an axial recess or cavity 268 (shown in broken lines) extending into protrusion 262 and filled with a portion of superabrasive mass 102 may be incorporated into cutting element 260.

Figure 15:
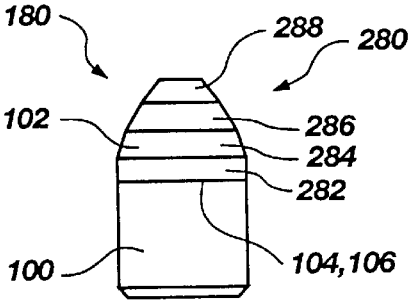
FIG. 15 is a side elevation of a cutting element according to the invention, the cutting element including a series of arcuate, contiguous chamfers on the exterior surface of the superabrasive mass.

FIG. 15 depicts a cutting element 280 having a plurality of contiguous arcuate chamfers 284, 286 and 288 at ever-increasing angles to the longitudinal axis of cutting element 280. Lowermost chamfer 284 is contiguous with cylindrical surface 282, lying immediately above interface 104 and boundary 106 with body 100. The angles of chamfers 284, 286 and 288 may be selected to approximate either a "ball" nose or a "cone" nose on the cutting element 280, and the leading portions of the chamfers comprise cutting surfaces 180 in this omnidirectional embodiment of the invention. In this embodiment, the interface 104 and boundary 106 lie on a single radial plane.

Figure 16:
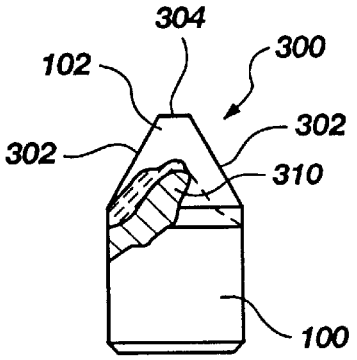
FIGS. 16 and 17 depict, respectively, profile and side views of a chisel-shaped cutting element including a protrusion of the insert body into the superabrasive mass.
Figure 17:
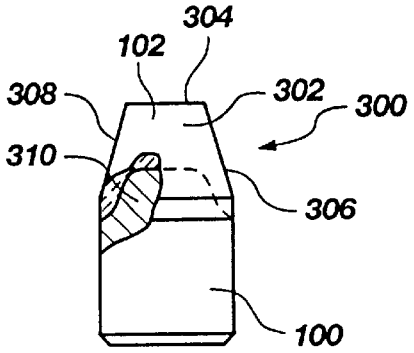

FIGS. 16 and 17 depict, respectively, a profile and a side view of a chisel-shaped cutting element 300 according to the invention, superabrasive mass 102 including two convergently-angled flats 302 terminating at ridge or crest 304 lying substantially transverse to the longitudinal axis of cutting element 300. In this embodiment, both leading and trailing surfaces 306 and 308 are also substantially planar. Body 100 protrudes into mass 102 as shown at 310.

Figure 18:
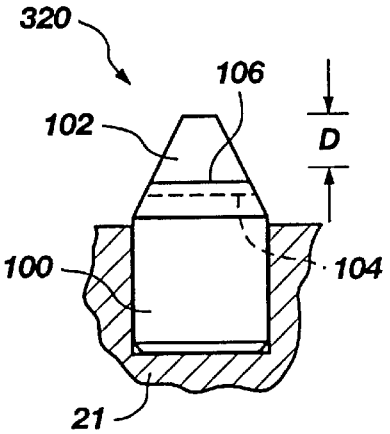
FIGS. 18 and 19 depict, respectively, profile and side views of a chisel-shaped cutting element having an interface between the superabrasive mass lying above the cutter surface and the cylindrical portion of the cutting element.
Figure 19:
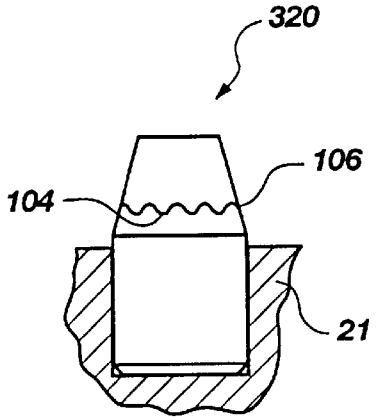

FIGS. 18 and 19 depict, respectively, a profile and a side view of yet another chisel-shaped cutting element 320 according to the invention. Cutting element 320 includes a convoluted interface 104 and boundary 106 between superabrasive mass 102 and carbide body 100, and is further noteworthy in that the boundary and interface lie substantially above the shell of cutter 21 and also above the DOC, D, of the cutting element 320. In this particular instance, the interface 104 is depicted as a series of mutually parallel ridges and interposed valleys, although the convoluted interface 104 might alternatively comprise radially-extending ridges and valleys. Further, the direction of the parallel ridges and valleys might be rotated 90 degrees (or some other angle, as desired) from the depicted orientation in this or other illustrated embodiments of the cutting element of the invention responsive to the magnitude of anticipated loading and the direction from which loading is likely to be encountered, the selected orientation preferably being one wherein the residual stresses resident in the interface area are least likely to be detrimental under loading.

Figure 20:
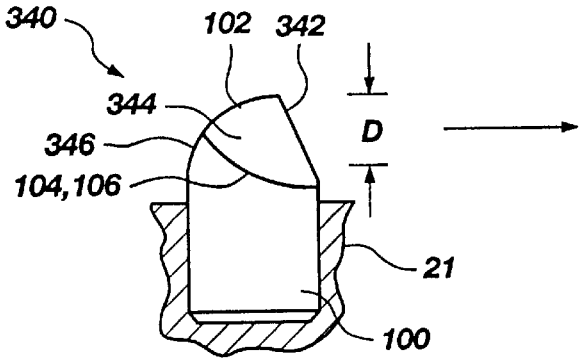
FIG. 20 depicts a side view of a cutting element according to the invention wherein the interface between the superabrasive mass and the insert body lies below the depth of cut on the leading face and flanks of the cutting element and above the depth of cut on the trailing face.

FIG. 20 shows a side view of another embodiment 340 of the cutting element of the invention, wherein the interface 104 and boundary 106 between the superabrasive mass 102 and insert body 100 lie outside of the DOC, D, on the leading face 342 (as indicated by the arrow showing the direction of rotation of cutter 21) and flanks 344 of the cutting element 340 and lie inside the DOC on the relatively protected, trailing face 346.

The present invention, as will be understood and appreciated by those of ordinary skill in the art, provides a cutting element in various embodiments of extremely robust characteristics, and which may be internally as well as externally configured to withstand specific types and magnitudes of stresses to which a particular cutting element may be subjected in accordance with its placement on a rolling cutter drill bit. With regard to loading of the cutting elements and the self-supporting nature of the superabrasive mass used therein, it is believed that superabrasive depth or thickness, taken in line with the compressive load, should be at least about one-quarter (¼) of the cutting element diameter to ensure that the superabrasive material, and not the underlying carbide or other metal of the insert body, sustains the loading on the cutting element so that the aforementioned yielding of the insert body and resulting damage to the superabrasive is avoided. Stated another way, if the loading characteristics of a particular cutting element may be predicted, the interface between the insert body and superabrasive mass may be designed to preferentially provide the requisite superabrasive material depth in areas of high stress, whereas elsewhere the thickness or depth of superabrasive may be minimized. Overall, and with general reference to cutting elements according to the present invention rather than specific reference to such elements as their diameter and location on a cutter may affect the superabrasive depth parameter, it may be generally desirable to provide a superabrasive depth, oriented as noted above, greater than about 0.040 inch. The depth figure may, of course, be higher in the instances of higher applied loads and harder rock formations.

Further, and by way of general parameters, the extent of projection of superabrasive mass of the cutting elements of the invention above the cutter surface or so-called "cone shell" is obviously a variable, depending at least in part on the placement of the cutting element (gage, heel, or inner row) and at least in part on the characteristics, such as hardness and abrasiveness, of the formation or formations which the bit is destined to penetrate during drilling operations. As most bits are not designed for maximum efficiency specific to only a single rock type, any bit and cutting element design will, as a matter of practicality, be a compromise to ensure adequate if not optimum performance during drilling of an interval. However, for gage cutting elements which are continuously shear cutting due to their unique position on the cutter, the projection of superabrasive material from the cutting element should be about twice the minimum gap between the gage surface and borehole wall to allow for wear on the heel inserts and cone steel, which will increase the expected DOC and the exposure of the gage cutting elements. Typical values for the minimum gap between the gage surface and borehole wall range from about 0.015 to about 0.060 inch. A suitable exemplary superabrasive projection range for a heel element will be about 0.100 to about 0.200 inch, while an inner row cutting element may have a typical exemplary projection range from about 0.150 to about 0.300 inch. Variances in bit size and formation characteristics may, on occasion, dictate other projection ranges other than the foregoing, and the invention is accordingly not so limited. As alluded to previously, the projection of superabrasive material need not extend about all sides of an insert, but may be focused in the predicted directions of cutting element movement, given the location of a particular insert. Further, the term "superabrasive projection" does not necessarily require that superabrasive material project the entire distance from the cutter shell to the outer tip of the cutting element, as long as the exposed boundary between the superabrasive material and the supporting insert body lies outside of the DOC.

During drilling operations, bit 11 is rotated and cutters 21, 23, 25 roll and slide over the bottom of the borehole and cutting elements according to the invention as disclosed herein crush, gouge and scrape or shear the formation material. As the cutting elements engage the formation, superabrasive cutting faces such as 154 and 180 and cutting edges such as 152 and 182 on the gage and heel rows scrape and shear formation material on the sidewall and in the comer of the borehole. The superabrasive masses 102 of the cutting elements are of sufficient depth or thickness, at least preferentially in a direction of predicted loading, to sustain such loading in a self-supporting manner so that the underlying material of the insert bodies does not yield under the loading. Further, the superabrasive exterior surfaces of the cutting elements of the invention provide a high degree of protection against abrasive and erosive wear, prolonging useful cutting element life. The fracture-tough metal carbide insert bodies of the cutting elements are, in turn, of sufficient strength and toughness to secure the cutting elements to the cutters under the cyclic loading of drilling operations without loss, cracking or fracture. Similarly, the cutting elements on the inner rows of the cutters induce fracture and failure through both shearing and crushing, cutting faces 180 and cutting edges 182 shearing formation material while the deep, self-supporting mass of superabrasive material sustains the compressive loading on the cutting elements without yielding, the underlying metal carbide of the insert bodies securing the cutting elements to the cutters being resistant to premature loss, cracking or fracture.

It should be further understood that the integrity of the superabrasive mass, due to its depth or thickness and consequent self-supporting nature (at least in the directions of maximum loading) will preclude its spalling, fracture or delamination from the insert body, unlike the relatively thin superabrasive coatings or jackets on prior art inserts, which are placed under tensile stress due to localized carbide yielding under a portion of the coating or jacket. Thus, even under contact stresses that exceed the yield strength of the body material (typically tungsten carbide, as previously noted), the superabrasive will retain its integrity.

The present invention, while having been described in terms of certain preferred, illustrated embodiments, is not so limited, and those of ordinary skill in the art will understand and appreciate that many modifications to the disclosed embodiments as well as combinations of various features of different embodiments may be made without departing from the scope of the invention as defined by the claims.

What is claimed is:

1. A cutting element for a rotating cutter-type bit for drilling subterranean formations, comprising:

a cutting element comprising an insert body formed of a fracture-tough material and having a longitudinal axis, said insert body being configured at an end thereof for at least partial insertion into an aperture formed in a shell of a rotating cutter of said bit; and a mass of superabrasive material secured to said insert body and projecting longitudinally therefrom opposite said end to exhibit a superabrasive exterior surface on said cutting element for engaging a subterranean formation, said mass including a depth of superabrasive material under said exterior surface sufficient to sustain, without substantial damage to said cutting element, loading thereon of a magnitude at least as great as a yield strength of said fracture-tough material of said insert body.

2. The cutting element of claim 1, wherein said loading is directionally dependent upon a location of the cutting element on the cutter and is selected from a group of directions comprising loading substantially in alignment with said longitudinal axis, loading substantially transverse to said longitudinal axis, and loading at an acute angle to said longitudinal axis, and said depth of superabrasive material is measured substantially in a direction of said loading.

3. The cutting element of claim 1, wherein said exterior surface includes at least one cutting edge proximate an outermost extent of said longitudinal projection and at least one cutting face adjacent said at least one cutting edge extending toward said end of said insert body.

4. The cutting element of claim 1, wherein said fracture-tough material of said insert body protrudes into said mass of superabrasive material.

5. The cutting element of claim 1, wherein said mass of superabrasive material protrudes into said fracture-tough material of said insert body.

6. The cutting element of claim 1, wherein said mass of superabrasive material and said fracture-tough material of said insert body meet at an interface exhibiting an exposed boundary on a lateral periphery of said cutting element.

7. The cutting element of claim 6, wherein said interface and said boundary are substantially aligned in a plane.

8. The cutting element of claim 7, wherein said plane is a substantially radial plane transverse to said longitudinal axis.

9. The cutting element of claim 6, wherein said interface extends longitudinally in of interior of said cutting element past at least a portion of said boundary in a direction of said projecting mass of said superabrasive material.

10. The cutting element of claim 6, wherein said interface extends longitudinally in of interior of said cutting element past at least a portion of said boundary in a direction of said insert body end.

11. The cutting element of claim 6, wherein said interface defines a recess in said fracture-tough material of said insert body.

12. The cutting element of claim 11, wherein said recess lies substantially along said longitudinal axis.

13. The cutting element of claim 11, wherein said recess faces at an angle to said longitudinal axis selected from a range of acute angles thereto and including a perpendicular angle to said longitudinal axis.

14. The cutting element of claim 11, wherein said fracture-tough material of said insert body extends longitudinally past at least a portion of said boundary in a direction of said projection and said recess provides said sufficient depth of superabrasive material.

15. The cutting element of claim 14, wherein a thickness of superabrasive material adjacent and to at least one side of said recess is of insufficient depth to sustain said loading.

16. The cutting element of claim 1, wherein said superabrasive exterior surface extends over substantially an entire end of said cutting element opposite said insert body end.

17. The cutting element of claim 1, wherein said superabrasive exterior surface faces to a side periphery of said cutting element.

18. The cutting element of claim 17, wherein said superabrasive exterior surface extends over an end of said cutting element opposite said insert body end.

19. The cutting element of claim 1, wherein said fracture-tough material comprises a cemented metal carbide, and said superabrasive material is selected from a group comprising polycrystalline diamond, thermally stable polycrystalline diamond, and cubic form nitride.

20. The cutting element of claim 1, wherein said cutting element is of generally cylindrical cross-section adjacent said end and tapers commencing at a location remote from said end to a lesser cross section away from said end, and said fracture-tough material of said insert body and said mass of superabrasive material define an exterior boundary about a periphery of said cutting element.

21. The cutting element of claim 20, wherein said boundary lies between said taper commencement location and said end.

22. The cutting element of claim 20, wherein said boundary lies past said taper commencement location away from said end.

23. The cutting element of claim 1, wherein said sufficient depth of superabrasive material is no less than about 0.040 inch.

24. The cutting element of claim 1, wherein said superabrasive mass is formed onto said insert body.

25. A drill bit for drilling a subterranean formation, comprising:

a bit body;

at least one rotatable cutter carried by said bit body, said at least one rotable cutter carrying a plurality of cutting elements projecting from an outer surface thereof, at least one of said plurality of cutting elements having a longitudinal axis and comprising a body of fracture-tough material having mounted thereto within said projection thereof from said outer surface a mass of superabrasive material of sufficient depth to sustain loading thereon, without substantial damage to said at least one cutting element, of a magnitude at least as great as a yield strength of said fracture-tough material of said cutting element body.

26. The drill bit of claim 25, wherein said superabrasive material projects outwardly a sufficient distance from said at least one cutter outer surface on a side of said cutting element facing a direction of cutting element movement whereby said formation is engaged only with superabrasive material on said facing side.

27. The drill bit of claim 26, wherein said superabrasive material mass and said fracture-tough material of said cutting element body define an interface therebetween exhibiting an exterior boundary on a side periphery of said at least one cutting element.

28. The drill bit of claim 27, wherein said boundary on said facing side lies above a predicted depth of cut of said at least one cutting element into said subterranean formation.

29. The drill bit of claim 27, wherein said boundary on said facing side lies beneath said outer surface of said at least one rotatable cutter.

30. The drill bit element of claim 27, wherein said cutting element body comprises an insert body having a first end of generally cylindrical transverse cross-section received in an aperture of like configuration formed into said cutter outer surface, and wherein said at least one cutting element tapers to a smaller transverse cross section as it projects from said cutter outer surface.

31. The drill bit of claim 30, wherein said boundary lies at least partially within said tapered projection.

32. The drill bit of claim 30, wherein said boundary lies below said tapered projection.

33. The drill bit of claim 25, wherein said superabrasive mass defines at least one cutting face oriented in a direction of cutter rotation, said at least one cutting face having at least one cutting edge lying proximate an outermost projection of said at least one cutting element.

34. The drill bit of claim 33, wherein said at least one cutting face lies at a negative backrake angle of between about 15 degrees and about 60 degrees to said longitudinal axis.

35. The drill bit of claim 25, wherein said loading is directionally dependent upon a location of the at least one cutting element on the at least one cutter and is selected from a group of directions comprising loading substantially in alignment with said longitudinal axis, loading substantially transverse to said longitudinal axis, and loading at an acute angle to said longitudinal axis, and said depth of superabrasive material is measured substantially in a direction of said loading.

36. The drill bit of claim 25, wherein said superabrasive mass exhibits an exterior surface including at least one cutting edge proximate an outermost extent of said projection and at least one cutting face adjacent said at least one cutting edge extending toward said cutter outer surface.

37. The drill bit of claim 25, wherein said fracture-tough material of said cutting element body protrudes into said mass of superabrasive material.

38. The drill bit of claim 25, wherein said mass of superabrasive material protrudes into said fracture-tough material of said cutting element body.

39. The drill bit of claim 25, wherein said mass of superabrasive material and said fracture-tough material of said cutting element body meet at an interface exhibiting an exposed boundary on a lateral periphery of said at least one cutting element.

40. The drill bit of claim 39, wherein said interface and said boundary are substantially aligned in a plane.

41. The drill bit of claim 40, wherein said plane is a substantially radial plane transverse to said longitudinal axis.

42. The drill bit of claim 39, wherein said interface extends longitudinally in an interior of said at least one cutting element past at least a portion of said boundary in a direction of said projection.

43. The drill bit of claim 39, wherein said interface extends longitudinally in an interior of said at least one cutting element past at least a portion of said boundary in a direction of said cutter outer surface.

44. The drill bit of claim 39, wherein said interface defines a recess in said fracture-tough material of said cutting element body.

45. The drill bit of claim 44, wherein said recess lies substantially along said longitudinal axis.

46. The drill bit of claim 44, wherein said recess faces at an angle to said longitudinal axis selected from a range of acute angles thereto and including a perpendicular angle to said longitudinal axis.

47. The drill bit of claim 44, wherein said fracture-tough material of said cutting element body extends longitudinally past at least a portion of said boundary in a direction of said projection and said recess provides said sufficient depth of superabrasive material.

48. The drill bit of claim 47, wherein a thickness of superabrasive material adjacent and to at least one side of said recess is of insufficient depth to sustain said loading.

49. The drill bit of claim 36, wherein said superabrasive exterior surface extends over substantially an entire end of said at least one cutting element opposite said cutter outer surface.

50. The drill bit of claim 36, wherein said superabrasive exterior surface faces to a side periphery of said at least one cutting element.

51. The drill bit of claim 50, wherein said superabrasive exterior surface extends over an end of said cutting at least one element opposite said cutter outer surface.

52. The drill bit of claim 25, wherein said fracture-tough material comprises a cemented metal carbide, and said superabrasive material is selected from a group comprising polycrystalline diamond, thermally stable polycrystalline diamond, and cubic boron nitride.

53. The drill bit of claim 25, wherein said at least one cutting element is of generally cylindrical cross-section adjacent said cutter outer surface and tapers commencing at a location remote from said cutter outer surface to a lesser cross section away from said cutter outer surface, and said fracture-tough material of said cutting element body and said mass of superabrasive material define an exterior boundary about a periphery of said at least one cutting element.

54. The drill bit of claim 53, wherein said boundary lies between said taper commencement location and an end of said at least one cutting element carried by said at least one cutter.

55. The drill bit of claim 53, wherein said boundary ties past said taper commencement location away from said cutter outer surface.

56. The drill bit of claim 25, wherein said sufficient depth of superabrasive material is no less than about 0.040 inch.

57. The drill bit of claim 25, wherein said superabrasive mass is formed onto said cutting element body.

* * * * *

UNITED STATES PATENT AND TRADEMARK OFFICE

CERTIFICATE OF CORRECTION

PATENT NO. : 5,890,552
DATED : April 6, 1999
INVENTOR(S) : Danny E. Scott, et al.

It is certified that error appears in the above-indentified patent and that said Letters Patent is hereby corrected as shown below:

On the title page, item [56], insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 5 | 4 | 6 | 7 | 8 | 3 | 6 | 11/1995 | Grimes et al. | | | |
| | | 5 | 5 | 6 | 6 | 7 | 7 | 9 | 10/1996 | Dennis | | | |
| | | | | | | | | | | | | | |

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | 0 | 3 | 8 | 9 | 8 | 0 | 0 | A 1 | 10/1990 | EP | | | | |
| | 0 | 4 | 8 | 0 | 8 | 9 | 5 | A 2 | 04/1992 | EP | | | | |
| | 2 | 2 | 7 | 5 | 0 | 6 | 8 | A | 08/1994 | GB | | | | |
| | WO | 95 | 1 | 6 | 5 | 3 | 0 | | 06/1995 | PCT | | | | |
| | 2 | 2 | 9 | 9 | 1 | 1 | 1 | A | 09/1996 | GB | | | | |
| | 2 | 3 | 0 | 5 | 4 | 4 | 9 | | 05/1997 | GB | | | | |
| | 2 | 3 | 0 | 7 | 9 | 3 | 1 | A | 06/1997 | GB | | | | |
| | | | | | | | | | | | | | | |

UNITED STATES PATENT AND TRADEMARK OFFICE

CERTIFICATE OF CORRECTION

PATENT NO. : 5,890,552
DATED : April 6, 1999
INVENTOR(S) : Danny E. Scott, et al.

It is certified that error appears in the above-indentified patent and that said Letters Patent is hereby corrected as shown below:

OTHER DOCUMENTS (Including Author, Title, Date, Pertinent Pages, Etc.)

| |
|---|
| Search Report, dated 19 August 1998(2 pages) |

Signed and Sealed this

Twenty-sixth Day of October, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,890,552
DATED : April 6, 1999
INVENTOR(S) : Scott et al.

It is certified that error appears in the above-identified patent and that said Letters Patent is hereby corrected as shown below:

Title page,
In the Abstract, item [57], line 15, after "shell" insert -- . --

Drawings,
Fig. 2, change reference numeral "300" to -- 30 -- and change reference numeral "302" to -- 32 --.

Column 1,
Line 30, after "formations" delete ",";
Line 30, change "rolling cutter" to -- rolling-cutter --;
Lines 38-39, change "rolling cone" to -- "rolling-cone" --;
Line 46, after "Beaumont" insert -- , --;

Column 2,
Line 53, change "cutter." to -- cutters --;

Column 3,
Line 1, change "08633,983," to -- 08/633,983, --;
Line 13, change "high-temperature formed," to -- high-temperature-formed, --;
Line 15, after "and" insert -- , --;
Line 42, after "great" delete ";" and insert -- , -- therefor;
Line 52, change "diamondjacketed" to -- diamond-jacketed --;

Column 4,
Line 4, change "or to with regard the" to -- or with regard to --;
Line 5, after "mounting" insert -- the --;
Line 7, change "elements" to -- element --;
Line 8, change "rolling cutter" to -- rolling-cutter --;
Line 17, change "rolling cutter" to -- rolling-cutter --;

Column 6,
Line 34, after "heel" insert -- cutting --;

UNITED STATES PATENT AND TRADEMARK OFFICE

CERTIFICATE OF CORRECTION

PATENT NO. : 5,890,552
DATED : April 6, 1999
INVENTOR(S) : Scott et al.

It is certified that error appears in the above-identified patent and that said Letters Patent is hereby corrected as shown below:

Column 7,
Line 1, delete the qoutation marks around "working tip";
Line 2, change "working tip" to -- "working tip"--;
Line 41, change "rolling cutter" to -- rolling-cutter --;
Line 50, change "rolling cutter" to -- rolling-cutter --;

Column 8,
Lines 7-8, change "rolling cutter" to -- rolling-cutter --;
Line 34, after "cylindrical" insert -- , --;

Column 9,
Lines 7, 8-9,10,12, 16, 26, 43-44, 62, 65, change "sidewall 300" to -- sidewall 30 —;
Lines 27-28, change "fine material 302" to -- fine material 32 --;
Line 40, change "cutter" to -- outer --;
Line 49, delete "cutting";

Column 10,
Line 4, change "sidewall 300" to -- sidewall 30--;
Line 6, change "angleα" to -- angle α --;
Lines 10-11, change "sidewall 300" to -- sidewall 30--;
Line 36, change "bevelled" to -- beveled --;
Line 37, change "Bevelled" to -- Beveled --;
Line 48, change "bevelled" to -- beveled --;

Column 11,
Line 14, change "rolling cone" to -- rolling-cone --;
Line 16, delete "," after "diameter";

Column 13,
Line 1, change "surfaces" to -- faces --;
Lines 47-48, change "rolling cutter" to -- rolling-cutter --; and Column 14,
Line 51, change "comer" to -- corner --.

UNITED STATES PATENT AND TRADEMARK OFFICE

CERTIFICATE OF CORRECTION

PATENT NO. : 5,890,552
DATED : April 6, 1999
INVENTOR(S) : Scott et al.

It is certified that error appears in the above-identified patent and that said Letters Patent is hereby corrected as shown below:

Claim 9, Column 16,
Line 2, change "in of" to -- in an --;

Claim 10, Column 16,
Line 6, change "in of" to -- in an --;

Claim 19, Column 16,
Line 39, change "form" to -- boron --;

Claim 20, Column 16,
Line 43, change "cross section" to -- cross-section --;

Claim 26, Column 17,
Line 7-8, change "said at least one cutter outer surface on a side of said cutting" to -- said cutter outer surface on aside of said at least one cutting --;

Claim 30, Column 17,
Line 24, delete "element";
Line 29, change "cross section" to -- cross-section --;

Claim 51, Column 18,
Lines 39-40, change "said cutting at least one element" to -- said at least one cutting element --;

Claim 53, Column 18,
Line 50, change "cross section" to -- cross-section --; and

UNITED STATES PATENT AND TRADEMARK OFFICE

CERTIFICATE OF CORRECTION

PATENT NO. : 5,890,552
DATED : April 6, 1999
INVENTOR(S) : Scott et al.

It is certified that error appears in the above-identified patent and that said Letters Patent is hereby corrected as shown below:

Claim 55, Column 18,
Line 59, change "ties" to -- lies --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*